United States Patent [19]

Black

[11] Patent Number: 4,653,643

[45] Date of Patent: Mar. 31, 1987

[54] TAMPER RESISTANT PACKAGE

[75] Inventor: Roger A. Black, Bradenton, Fla.

[73] Assignee: 501 Safety Container Corp., Bradenton, Fla.

[21] Appl. No.: 848,937

[22] Filed: Jun. 7, 1986

[51] Int. Cl.[4] ..... B65D 81/18; B65D 85/56; B65D 77/04

[52] U.S. Cl. ..... 206/528; 206/540; 206/522; 206/807; 215/271; 220/66; 53/449

[58] Field of Search ..... 206/459, 540, 522, 807; 215/230, 365, 271, 276; 220/66, 214; 53/449, 432; 383/3

[56] References Cited

U.S. PATENT DOCUMENTS

| | | | |
|---|---|---|---|
| 1,973,634 | 9/1934 | Lang | 53/432 |
| 2,040,798 | 5/1936 | Schoonmaker | 215/271 |
| 2,279,155 | 4/1942 | Wright | 215/271 |
| 2,833,398 | 5/1958 | Marshall | 206/807 |
| 3,469,760 | 9/1969 | Rausing et al. | 53/449 |
| 3,522,124 | 7/1970 | Peyraud | 53/449 |
| 4,172,152 | 10/1979 | Carlisle | 53/449 |
| 4,434,893 | 3/1984 | Barlow | 206/522 |
| 4,449,632 | 5/1984 | Marusiak, Jr. | 206/484 |

FOREIGN PATENT DOCUMENTS

| | | | |
|---|---|---|---|
| 727465 | 2/1966 | Canada | 53/432 |
| 97265 | 10/1939 | Sweden | 215/271 |

*Primary Examiner*—William Price
*Assistant Examiner*—Brenda J. Ehrhardt
*Attorney, Agent, or Firm*—Charles J. Prescott

[57] ABSTRACT

A tamper-resistant package for articles such as pharmaceuticals and medicine which are themselves first enclosed within a first closed and sealed container. The first container is then enclosed within a second container, there being a void between the two containers. The second container includes a lid which is secured over its opening. Positioned between the lid and the opening of the second container is a permanently adhered thin sheet of elastic material or membrane which is impermeable to gas or liquid. This membrane is permanently adhered to the opening of the second container after the sealed first container and a portion of solid chemical material possessing the physical property of sublimation is placed into the void. In conjunction with the expansion into gas of the solid sublimation material at atmospheric pressure and normal ambient temperature subsequent to the permanent adhesion of the lid to the membrane and over the opening of the second container, the membrane stretches and expands outwardly from an aperture in the lid to produce visible and touchable positive evidence that the package has not been tampered with. The membrane is permanently destroyed when the lid is removed or when the membrane is punctured, cut or otherwise ruptured in any manner. This physical indicia remains in tact for at least the shelf life of the article, unless tampering occurs. A transparent protective cover releasably connected over the lid is also provided.

9 Claims, 2 Drawing Figures

TAMPER RESISTANT PACKAGE

BACKGROUND OF THE INVENTION

This invention relates generally to tamper-resistant packages, and more particularly to a dual container package and method for packaging articles such as pharmaceuticals and medicines within the smaller inner container.

With the recent rash of deaths and serious illness as a result of tampering with over-the-counter pharmaceuticals and drugs, considerable emphasis has been directed to the inadequacy of existing tamper-resistant and tamper-proof packages and methods of constructing same. Most of the prior art devices are not truly tamper-proof, in that tampering with the articles therein is possible. Alternately, prior art discloses tamper-resistant packages and packaging devices which are intended to provide some indicia or physical evidence that tampering has occured therewith.

An example of a claimed tamper-proof package is disclosed in U.S. Pat. No. 4,449,632, directed to a dual container arrangement having a pressurized void therebetween, the outer container or enclosure creating the pressurization as it is sealed about the inner container. Additional elastic layers are also provided around the second container to enhance the tamper-proof features. Other prior art which discloses air pressurized protective packaging are shown in U.S. Pat. No. 2,835,596 directed to a method for packaging marshmellows which uses an air pressurizing bag to provide protective packaging. U.S. Pat. No. 2,833,398 discloses an inflation cushioned sealed container wherein a pressurized bag is placed within a container above the article to be protected in order to provide protective packaging in a tamper-resistant closure for the article. U.S. Pat. No. 4,434,893 is, likewise, directed to a tamper-evident packaging device which includes an inner and an outer gas tight container each having flexible walls and pressurization with gas above atmospheric pressure to inflate their flexible walls. However, none of these have received any substantial degree of commercial acceptance.

With respect to tamper-resistance and tamper-evidence type packages, U.S. Pat. No. 2,880,900 discloses an outer sealed cushion or container employing a vacuum to provide packaging protection of the articles in the inner container. Likewise, the packaging device disclosed in U.S. Pat. No. 4,436,203 is directed to a dual inner and outer packaging device wherein tampering is rendered obvious by the change in the physical shape of the inner container which is pressurized while the void between the inner and outer layers is at a vacuum or less than atmospheric pressure. Other patents which include a variation of this theme wherein loss of the vacuum within a vacuum sealed package provides the resistive and indicative tampering virtues are disclosed in U.S. Pat. Nos. 2,040,798, 3,152,711, 3,160,302, 2,197,004, 3,736,899, 3,443,711, and 2,034,739.

Still other tamper-resistant seals are disclosed in U.S. Pat. Nos. 681,774 and 1,039,843 which are directed to tamper-resistant seals.

The present invention, although not providing tamper proof features, does provide a packaging which is virtually fool proof with respect to its tamper evident novel features. The method of construction is convenient and economical, as well as reliable and provides a tamper-evident seal which cannot be disrupted, disturbed, or be otherwise penetrated without the potential user or purchaser having clear and convincing evidence of the tampering.

SUMMARY OF THE INVENTION

The present invention relates generally to a tamper-resistant package for articles such as pharmaceuticals, drugs and medicine which are themselves first enclosed within a first closed and sealed container. The first container is then enclosed within a second container, there being a void between the two containers. The second container includes a lid or closure which is secured over its opening. Positioned between the lid and the opening of the second container is a permanently adhered thin sheet of elastic material or membrane which is impermeable to gas or liquid. This membrane is permanently adhered to the opening of the second container after the sealed first container and a portion of solid chemical material possessing the physical property of sublimation at ambient temperature and atmospheric pressure is placed into the void. In conjunction with the expansion into gas of the solid sublimation material at atmospheric pressure and normal ambient temperature subsequent to the permanent adhesion of the lid to the membrane and over the opening of the second container, the membrane stretches and expands outwardly from an aperture in the lid to produce visible and touchable positive evidence that the package has not been tampered with. The membrane is permanently destroyed when the lid is removed or when the membrane is punctured, cut or otherwise ruptured in any manner. This physical indicia remains in tact for at least the shelf life of the article, unless tampering occurs. A releasably attachable clear cover may also be provided over the lid to provide resistance against mischievous destruction of the membrane.

It is therefore an object of this invention to provide a package for articles which will give clear, quick and reliable evidence of intrusion into the package even by small objects such as extremely fine hypodermic needles.

It is another object of this invention to provide a package for drugs, medicines, pills, capsules and the like which is inexpensive and reliable to manufacture.

It is another object of this invention to provide a package which will indicate by both touch and sight in virtually total reliable fashion that tampering with the contents has occurred.

It is another object of this invention to provide a package which will have a useful shelf life for the tamper-evident features which will reliably last at least as long as that of the articles contained therein.

It is another object of this invention to provide a package which includes means for resisting mischievous destruction of the tamper-evident features.

In accordance with these and other objects which will become apparent hereinafter, the instant invention will not be described with reference to the accompanying drawings in which:

DETAILED DESCRIPTION OF THE INVENTION

Figure 1:
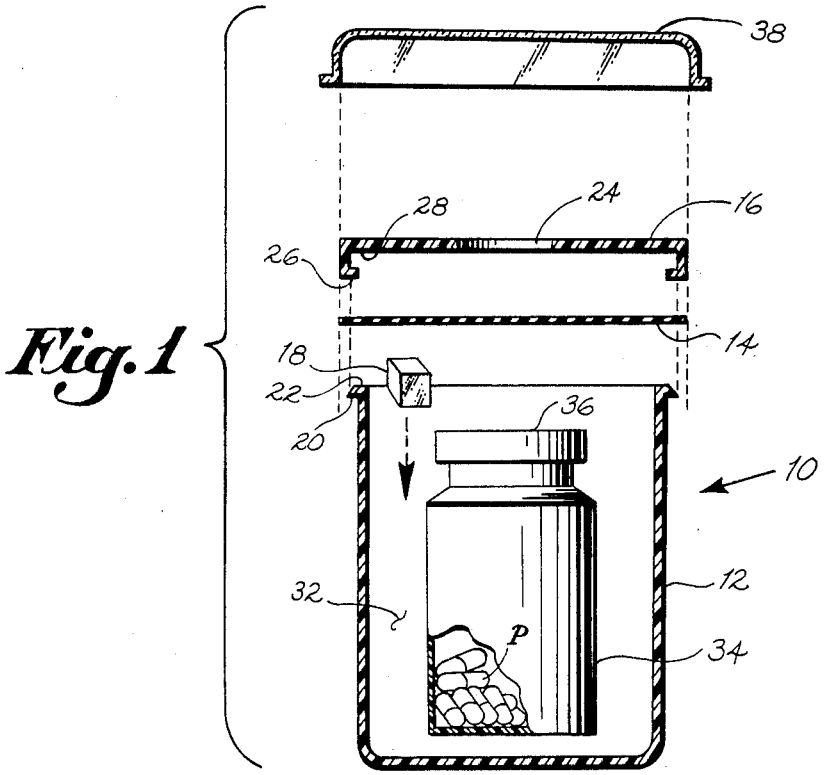
FIG. 1 is a typical front elevation section view of the outer container in exploded position with the inner container and the portion of sublimation material inserted therein.

Referring now to the drawings, the invention is designated generally by numeral 10 and includes an outer container 12 and an inner container 34. This inner container 34 includes articles to be protected therein, here shown in FIG. 1 as pharmaceutical capsules P. The articles P to be protected may also be medicines, pills, and various other articles. Inner container 34 includes cap 36 which has been secured thereunto to provide a sealed environment for the articles P. Both inner and outer containers 34 and 12 have circular cross sections in the preferred embodiment.

The inner and outer containers 34 and 12 may be fabricated of a suitable molded plastic material and the cap 36, in addition to having a conventional mechanical sealable attachment thereto, may also include means for hermetic sealing of the entire inner container 34.

The outer container 12 is sized such that a void 32 exists between the outer walls of the inner container 34 and the inner walls of the outer container 12. This void is necessary to provide an air or gas space which will be pressurized as herebelow described.

The outer container 12 includes a continuous circular perimeter or opening margin 22 having an extended portion 20 and forming an opening 36 for container 12. Lid 16 is also provided which is mateable over the opening margin 22 and extended portion 20 by flexible snap portion 26. By this arrangement then, the cap 16 in a well known manner may be snapped into place over the opening margin 22 of container 12. Alternately, cap 12 may be engagable onto the opening margin 22 and the adjacent side walls by mating threaded portion or the like.

Positioned between the cap 16 and the open margin 22 of outer container 12 is an elastic membrane 14. This membrane 14 is fabricated preferrably of thin elastomeric material which is totally impervious to the transmittal of gas or liquid therethrough.

After the inner container 34 is placed through opening 36 and into the outer container 12, a portion of solid chemical material 18 which possesses the physical characteristics of sublimation is deposited into the void 32. The property of sublimation as herein described refers to any solid material which can pass directly from a solid to a gaseous state at ambient temperatures and atmospheric pressure without becoming a liquid. The preferred choice for such a solid material is carbon dioxide or "dry ice" which sublimates into carbon dioxide, an inert gas with respect to the article P and other components of this invention 10.

Figure 2:
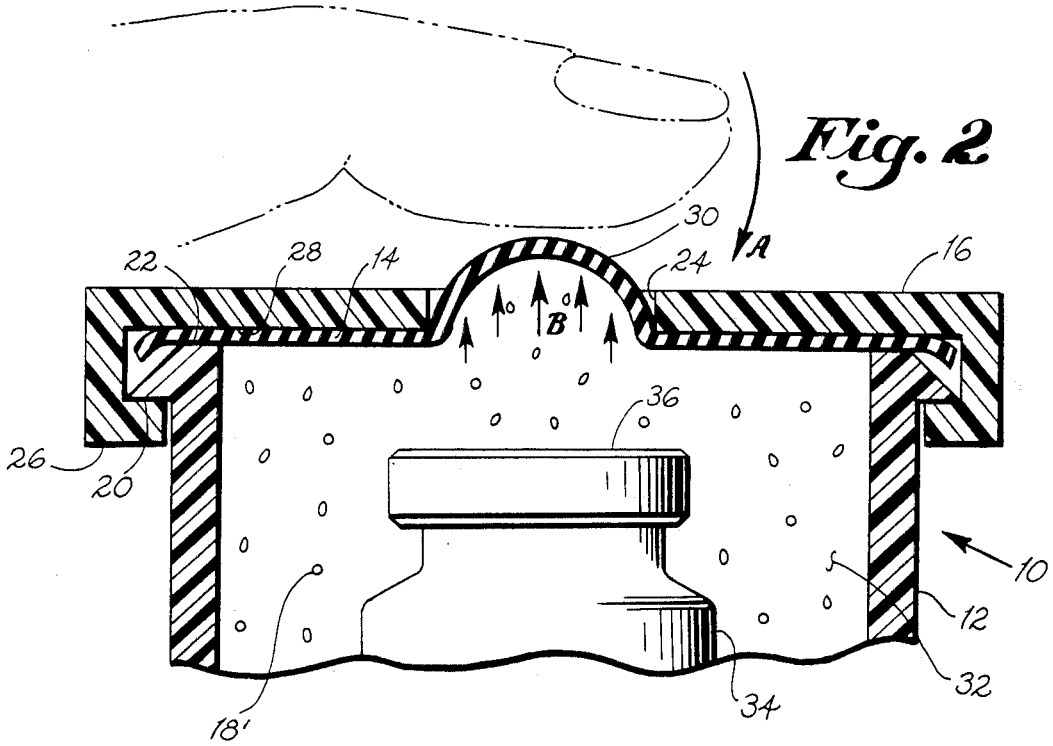
FIG. 2 is a typical enlarged vertical elevation section view of the invention in assembled position and showing one mode of tamper evident inspection.

After the solid sublimation material 18 is dropped into the void 32, the membrane 14 is then, by an adhesive substance applied to the container margin 22, permanently adhered over the opening 36 of outer container 12. The lid 16 is, then, likewise snapped or screwed over the membrane 14 and interlocked over the extended portion 20 of container 12 after an additional layer of adhesive is applied along the surface 28. Once the membrane 14 and cap 16 are permanently adhered in assembled position as shown in FIG. 2, the solid sublimation material 18, then becoming a gas as shown at numeral 18', expands to produce a positive pressure in the void 32. Because the void 32 is now a completely sealed and gas impervious volume, pressure rapidly builds within the void 32.

Lid 16 includes aperture 24, which is, preferrably, centrally located in and through the circular lid 16 and, as the expanding solid sublimation material 18 becomes a gas 18', pressure is exerted on the inside of membrane 14 in the direction of arrows B, producing a bubble or raised portion 30 of membrane 14. The amount of the solid sublimation material 18 is of a predetermined size to produce a suitable amount of gas 18' and pressure B such that the membrane 14 will expand at bubble portion 30 out of the aperture 24 in cap 16 beyond the outer surface of the cap 16 but will not rupture the membrane 14.

Once the entire package, including the expanded gas 18' has stablized, the existence of positive pressure B within the void 32 may be tested or evidenced in two ways. First, the bubble portion 30 is viewable as it extends through aperture 24. Second, by finger pressure in the direction of arrow A as shown, the internal pressure in the void can be increased by collapsing the bubble portion 30, as well as providing a positive touch response with respect to evidence of tampering.

This increased pressure caused by the compressure of bubble portion 30, provides an additional margin of assurance that tampering has not occured. By this increased pressurization means, then, if a devious mind and devices not now known to the inventor have penetrated the membrane 14 and contaminated the article P, but have somehow done so without leaving a hole therethrough sufficient for the pressurized gas 18' to escape, then, by increasing that pressure through compression of bubble portion 30, the increased pressure should serve to force gas 18' out of the intrusion caused breach of the membrane 14, thereby decreasing the size of the bubble portion 30 during or after finger pressure release.

Because lid 16 has been permanently adhered at 28 to the membrane 14, and because the membrane 14 has been permanently adhered to the container opening margin 22, should a would-be intruder attempt to remove same in order to tamper with the articles P, the membrane 14 will be destroyed and rendered unuseable, even though the lid 16 may be reattached and appear in tact. Nonetheless, the bubble portion 30 caused by the gas pressure at B by gas 18' will have been destroyed or released, and no bubble portion 30 will any longer be viewable or touchable through aperture 24 thereafter.

To protect the membrane 14 as it protrudes through aperture 24 as the bubble portion 30, a clear, disposable cover 38 may also be provided which releasably snaps into position over lid 16 in any well known manner. By this means, then the visible evidence of tampering remains readily available while the feel or touch mode of evidence is also available by the simple removal of the cover 38 for finger testing as previously described. However, mischievous random distruction of the membrane 14 by poking or cutting with a sharp object after the package 10 is placed on retail shelves is somewhat thwarted.

The preferred method for constructing the packaging 10 is as follows. After the article has been placed within the first container, that container is closed and inserted into a second larger container through its opening. The two containers are sized such that there exists a void therebetween. Next a portion of solid chemical of predetermined size and possessing the physical property of sublimation is placed into the void. The opening of the second container is then sealed over by permanent adhesion means with an elastic membrane which is impermeable to gas and water. This is followed by the releasable attachment of a lid over the opening of the second container and the membrane. This releasable interengagement between lid and second container opening is by conventional well known mechanical means. Additionally, in conjunction with the assembly of the lid onto the second container, a second permanent adhesion means is placed between the surface of the lid and the membrane. The entire package is then allowed to stand for a time sufficient for the solid material to change state into gas. This change of state causes a pressurization within the void and, thus the membrane expands elastically out through an aperature provided in the lid.

While the instant invention has been shown and described herein in what is conceived to be the most practical and preferred embodiment, it is recognized that depatures may be made therefrom within the scope of this invention, which is therefore not to be limited to the details disclosed herein, but is to be accorded the full scope of the claims so as to embrace any and all equivalent apparatus and articles.

What is claimed is:

1. A package for an article comprising:

a first closed container into which the article is placed;

a second container having an opening into which said first container is inserted, said first and second containers sized such that there is a void between the outer surface of said first container and the inner surface of said second container;

an elastic membrane impermeable to gas and liquid permanently adhered to and covering said second container;

a portion of solid chemical material possessing the physical property of sublimation insertion to said void prior to permanent adhesion of said elastic membrane to said second container opening; and a lid having an aperature therethrough, said lid permanently adhered over said membrane and in releasable locking engagement with the opening of said second container;

said solid material changing to a gas after permanent adhesion of said elastic membrane to said second container opening so as to pressurize said void;

said elastic membrane expanding out of said aperture in response to pressurization in said void so as to produce visible and touchable indicia as evidence of whether said package has been tampered with;

said elastic membrane destroyed and rendered unreuseable in response to removal of said lid.

2. A package for an article as set forth in claim 1, wherein:

the gas produced by sublimation of said solid material is inert with respect to the article.

3. A package for an article as set forth in claim 2, wherein:

said solid material is dry ice.

4. A package for an article as set forth in claim 1, wherein:

said elastic membrane is so gas impervious that the pressure in said void will be substantially maintained for at least the shelf life of the article such that the visible and touchable indicia is also maintained.

5. A package for an article as set forth in claim 1, wherein:

said elastic membrane is elastomeric.

6. A package for an article as set forth in claim 1, wherein:

said first container is hermetically sealed.

7. A package for an article as set forth in claim 1, further comprising:

a cover releasably connectable over said lid for preventing damage to said membrane by exterical means.

8. A package for an article as set forth in claim 7, wherein:

said cover is transparent.

9. A method for packaging an article comprising the steps of:

a. placing the article contained in a first closed container into the opening of a second larger container, a void existing between said first and second containers;

b. depositing a portion of solid chemical material possessing the physical property of sublimation into said void;

c. permanently adhering a thin elastic membrane impermeable to gas and liquid to and covering said second container opening;

d. releasably locking a lid having an aperture therethrough over said second container opening and said membrane while concurrently permanently adhering said lid to said membrane;

e. allowing said solid material to sublimate into a gas thus pressurizing said void and forcing said membrane to expand out through said aperture.

* * * * *